US011242176B2

(12) United States Patent
Albonetti et al.

(10) Patent No.: US 11,242,176 B2
(45) Date of Patent: Feb. 8, 2022

(54) CLOSURE ELEMENT FOR A CONTAINER

(71) Applicant: SACMI COOPERATIVA MECCANICI IMOLA SOCIETA' COOPERATIVA, Imola (IT)

(72) Inventors: Danilo Albonetti, Imola (IT); Andrea Sallioni, Molinella (IT); Antonino Lo Piccolo, Battipaglia (IT); Steven White, Godmanchester (GB); Doriano Naldi, Ozzano Dell'emilia (IT)

(73) Assignee: SACMI COOPERATIVA MECCANICI IMOLA SOCIETA' COOPERATIVA, Imola (IT)

( * ) Notice: Subject to any disclaimer, the term of this patent is extended or adjusted under 35 U.S.C. 154(b) by 661 days.

(21) Appl. No.: 16/074,880

(22) PCT Filed: Feb. 23, 2017

(86) PCT No.: PCT/IB2017/051034
§ 371 (c)(1),
(2) Date: Aug. 2, 2018

(87) PCT Pub. No.: WO2017/145083
PCT Pub. Date: Aug. 31, 2017

(65) Prior Publication Data

US 2019/0039786 A1 Feb. 7, 2019

(30) Foreign Application Priority Data

Feb. 23, 2016 (IT) ..... 102016000018365

(51) Int. Cl.

| | |
|---|---|
| ***B65D 41/17*** | (2006.01) |
| ***B65D 43/02*** | (2006.01) |
| ***B65D 41/16*** | (2006.01) |

(52) U.S. Cl.
CPC ..... *B65D 41/17* (2013.01); *B65D 41/165* (2013.01); *B65D 43/0231* (2013.01)

(58) Field of Classification Search
CPC .. B65D 41/17; B65D 41/165; B65D 43/0231; B65D 41/46; B65D 41/00; B65D 41/0435; B65D 41/0407; B65D 41/04
(Continued)

(56) References Cited

U.S. PATENT DOCUMENTS 3,270,904 A * 9/1966 Curry ..... B65D 41/0435 215/318
3,371,813 A * 3/1968 Owen ..... B65D 41/0457 215/318

(Continued)

FOREIGN PATENT DOCUMENTS

CN 102123919 A 7/2011
DE 3332188 A1 3/1984

(Continued)

*Primary Examiner* — J. Gregory Pickett
*Assistant Examiner* — Tia Cox
(74) *Attorney, Agent, or Firm* — Pearne & Gordon LLP

(57) ABSTRACT

A closure element of the press-twist type for closing a container comprises:

a capsule having a side wall extending about an axis, and a transverse panel extending transversely to said axis, an annular seal for sealingly engaging with a mouth of the container.

The annular seal is made of a PVC-free material and comprises:

a side portion arranged in contact with the side wall of the capsule;

a front portion extending from the side portion towards said axis;

a deformability promoting element for increasing deformability of the front portion, the deformability promoting element comprising a recessed zone configured to be at (Continued)

least partially filled by the material forming the front portion when the front portion is pressed against an edge of the container delimiting the mouth.

15 Claims, 6 Drawing Sheets

(58) Field of Classification Search
USPC ..... 215/44, 341–344, 315–318
See application file for complete search history.

(56) References Cited

U.S. PATENT DOCUMENTS

| | | | | | |
|---|---|---|---|---|---|
| 3,448,881 | A * | 6/1969 | Zipper | B65D 41/0457 | 215/318 |
| 3,494,497 | A * | 2/1970 | Vercillo | B65D 41/0442 | 215/318 |
| 3,690,497 | A * | 9/1972 | Lecinski, Jr. | B65D 41/0457 | 215/318 |
| 3,741,423 | A * | 6/1973 | Acton | B65D 41/0457 | 215/318 |
| 3,828,693 | A * | 8/1974 | Kampmann | B61D 19/007 | 105/378 |
| 3,868,038 | A * | 2/1975 | Hadley | B65D 41/0464 | 215/305 |
| 4,000,825 | A * | 1/1977 | Westfall | B65D 41/0457 | 215/318 |
| 4,244,480 | A | 1/1981 | Puig Planas | | |
| 4,308,965 | A * | 1/1982 | Dutt | B65D 41/0442 | 215/345 |
| 4,322,011 | A * | 3/1982 | Mumford | B65D 41/3442 | 215/270 |
| 4,552,279 | A * | 11/1985 | Mueller | B65D 41/0457 | 215/318 |
| 4,576,299 | A * | 3/1986 | Lecinski, Jr. | B65D 41/0457 | 215/318 |
| 4,603,786 | A * | 8/1986 | Lecinski, Jr | B65D 41/0457 | 215/318 |
| 4,709,825 | A * | 12/1987 | Mumford | B65D 41/0457 | 215/318 |
| 4,717,034 | A * | 1/1988 | Mumford | B65D 41/0428 | 215/318 |
| 4,721,219 | A * | 1/1988 | Dullabaun | B65D 79/005 | 215/230 |
| 4,863,030 | A * | 9/1989 | Bayer | B65D 21/0209 | 206/427 |
| 4,989,740 | A * | 2/1991 | Vercillo | B65D 41/0457 | 215/252 |
| 5,346,082 | A * | 9/1994 | Ochs | B65D 41/3409 | 215/252 |
| 5,955,163 | A | 9/1999 | White | | |
| 6,056,136 | A * | 5/2000 | Taber | B65D 51/145 | 215/252 |
| 6,179,139 | B1 * | 1/2001 | Heilman | B65D 55/026 | 215/230 |
| 7,134,565 | B1 * | 11/2006 | Wan | B65D 41/0492 | 215/276 |
| 7,775,386 | B2 | 8/2010 | Falzoni | | |
| 7,891,511 | B2 * | 2/2011 | Mavin | B65D 41/485 | 215/317 |
| 8,297,458 | B2 * | 10/2012 | Sumimiya | B65D 41/045 | 215/329 |
| 8,916,078 | B2 | 12/2014 | Poel-Asendorf et al. | | |
| 9,315,306 | B2 * | 4/2016 | Taber | B65D 51/145 | |
| 9,662,813 | B2 | 5/2017 | Poel et al. | | |
| 10,640,264 | B2 | 5/2020 | Mangel | | |
| 2002/0175138 | A1 * | 11/2002 | Martin | B65D 41/17 | 215/318 |
| 2006/0021959 | A1 | 2/2006 | Falzoni | | |
| 2009/0139955 | A1 * | 6/2009 | Fraser | B65D 41/17 | 215/323 |
| 2010/0295211 | A1 | 11/2010 | Poel-Asendorf et al. | | |
| 2013/0026127 | A1 * | 1/2013 | Mangel | C08L 23/10 | 215/233 |
| 2014/0209611 | A1 | 7/2014 | Mangel | | |
| 2015/0028035 | A1 | 1/2015 | Mangel | | |
| 2015/0061184 | A1 | 3/2015 | Poel-Asendorf et al. | | |
| 2017/0050771 | A1 * | 2/2017 | Fink | B65D 1/023 | |
| 2020/0262617 | A1 | 8/2020 | Mangel | | |

FOREIGN PATENT DOCUMENTS

| | | | |
|---|---|---|---|
| FR | 2271993 | | 12/1975 |
| JP | S50150580 | A | 1/1977 |
| JP | 2014518815 | A | 8/2014 |
| TW | M493523 | U | 1/2015 |
| WO | 2006013443 | A2 | 2/2006 |

* cited by examiner

Fig.1
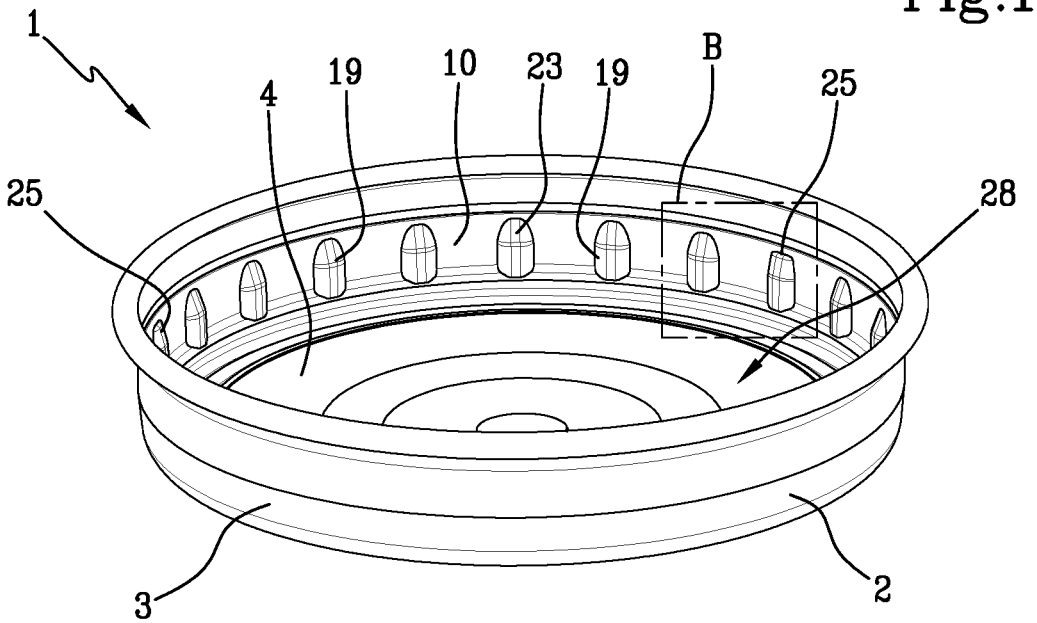
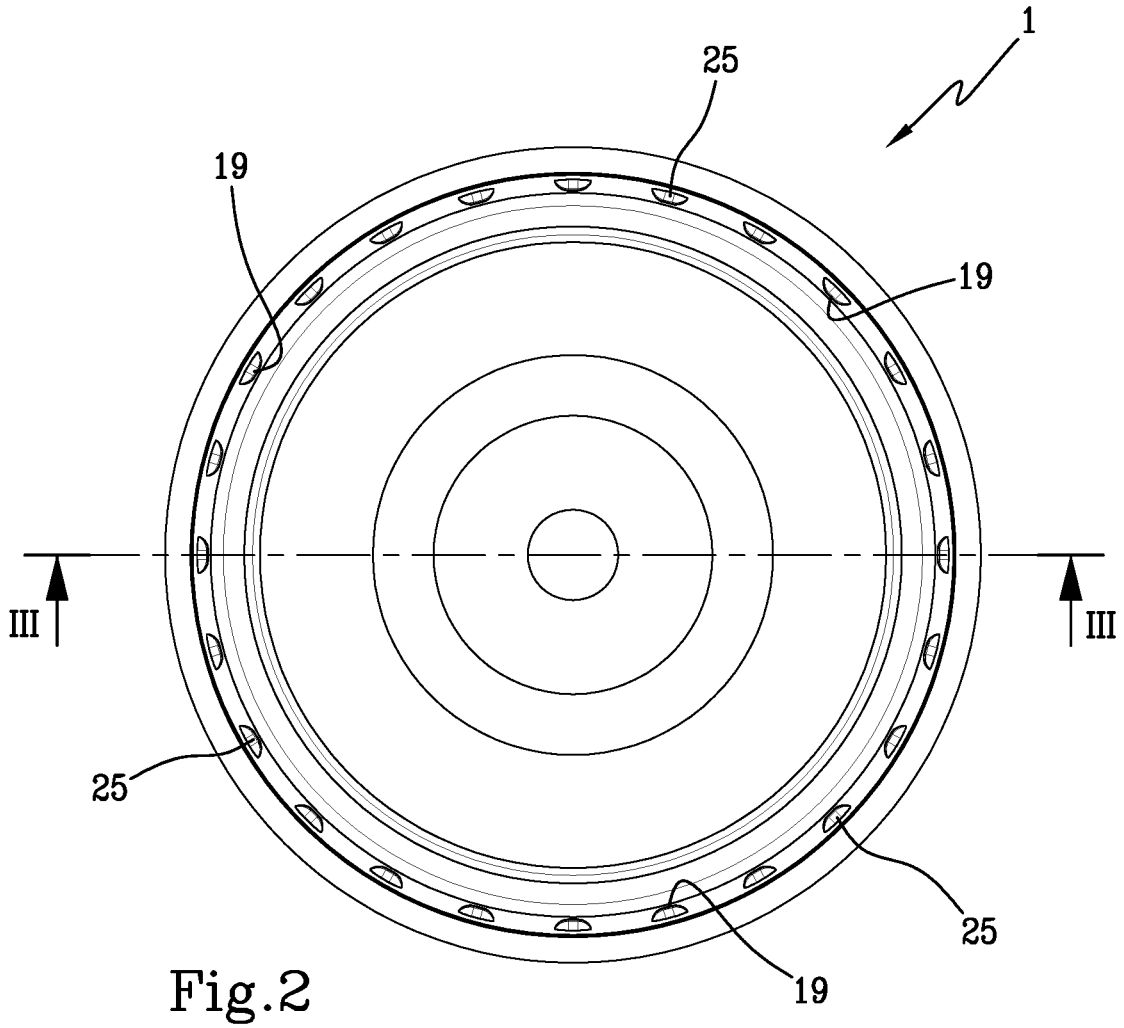
Fig.2

CLOSURE ELEMENT FOR A CONTAINER

The invention relates to a closure element for closing a container, particularly of the so-called "press-twist" type, i.e. a closure element which is applied onto the container by pressing the closure element on the container mouth, when the container is closed for the first time. Thereafter, the closure element is removed from the container by unscrewing.

The closure element according to the invention may be used for vacuum packaging of food products subjected to heat treatment, such as pasteurization, sterilization or the like. The food products which can be packaged by using the closure element according to the invention particularly comprise foodstuffs for the early years, generally referred to as "baby food", such as for example homogenized food. The closure element according to the invention may however also be used for other types of food products, such as sauces, juices, fish and seafood, meat-based products, animal foodstuffs and the like.

The closure element according to the invention can be particularly, but not exclusively, used for closing glass containers, such as cans or jars.

The closure elements of the "press-twist" type comprise a capsule, generally made of metal material, which is provided with a side wall extending about a longitudinal axis and a transverse panel arranged transversely to the longitudinal axis. The side wall is suitable for engaging with a neck of the container to be closed, whereas the transverse panel is suitable for closing an opening defined by the mouth of the container.

During production of the known closure elements, a sealing material, conformed as an annular seal, is introduced inside the capsule. This seal is arranged in a connection zone connecting the side wall and the transverse panel of the capsule, and continues in contact with an inner surface of the side wall.

A capping machine applies the closure element onto a neck of a container, the neck being provided with an external thread. The capping machine heats the seal to promote softening thereof. When the closure element is pressed onto the mouth of the container in order to be applied thereto, the external thread provided on the neck of the container forms a corresponding internal thread on the seal, by impression. The internal thread formed on the seal remains thereon even after the closure element has been cooled, so that the closure element may be unscrewed for opening the container and screwed again for closing the container.

Known seals are made of polyvinyl chloride (PVC) based material. Such materials may nevertheless contain toxic substances, which can be hazardous to the consumer's health if released into the product present inside the container.

It has therefore been proposed to manufacture the seals of press-twist closure elements with materials that do not contain PVC, also known as "PVC-free" materials.

In the baby food field, performance of a seal is measured by a plurality of parameters as provided by international standards, particularly European standards. Among the parameters to be taken into account, vacuum tightness and unscrewing torque of the closure element are included.

PVC-free materials have physical, chemical and mechanical properties that are significantly different from the materials containing PVC. In particular, PVC-free materials are significantly stiffer than those containing PVC.

Hence, if the same geometry of a seal containing PVC is adopted when a seal is being produced with a PVC-free material, a closure element is obtained, which may prevent a sufficient degree of vacuum from being created inside the container, when the closure element is applied on the corresponding container, or which may require an excessive unscrewing torque. In this regard, it is desirable that the unscrewing torque is in the range 12-30 kg×cm.

Some examples of prior art closure elements are disclosed in DE 3332188, U.S. Pat. No. 4,863,030, FR 2271993 and US 2015/028035.

An object of the invention is to improve the closure elements of the known type, particularly the closure elements of the press-twist type.

A further object is to provide a closure element, particularly of the press-twist type, comprising a seal made of a PVC-free material, which ensures good performance when applied on a container.

In particular, it is desired to provide a closure element, which has a good vacuum tightness when applied on a container.

It is further desired to provide a closure element, which does not require an excessive unscrewing torque when the closure element needs to be removed from a container on which it was applied.

A further object of the invention is to provide a closure element which may be applied easily on a container.

According to the invention, there is provided a closure element of the press-twist type for closing a container, comprising:

- a capsule having a side wall extending about an axis, and a transverse panel extending transversely to said axis;
- an annular seal for sealingly engaging with a mouth of the container; wherein the annular seal is made from a PVC-free material and comprises:
- a side portion arranged in contact with the side wall of the capsule;
- a front portion which extends from the side portion towards said axis;
- a deformability promoting element for increasing deformability of the front portion, the deformability promoting element comprising a recessed zone which can be at least partially filled by the material forming the front portion, when the front portion is pressed against an edge of the container delimiting the mouth.

Thus, the edge may penetrate into the thickness of the front portion, thereby sealingly closing the container.

Owing to the invention, it is possible to obtain a closure element of the press-twist type, which closure element, when applied on the container, ensures an effective sealing action by the front portion of the annular seal, thus minimizing the risk that the product contained in the container deteriorates before use.

The closure element according to the invention can be used to close a container that, after being filled with a desired product and capped, is heated and subjected to processes of sterilization, pasteurization or the like. When the container, duly filled and capped, is heated, the temperature of the annular seal increases as well, which causes a softening of the material of the annular seal.

Subsequently the container is cooled, and a vacuum is created in an upper space of the container. Due to this vacuum, the transverse panel of the capsule is deformed, thereby bending towards the inside of the container.

Owing to the recessed zone on the annular seal of the closure element according to the invention, the material forming the front portion (which is still at a relatively high temperature and in a softening state), can be easily deformed when the transverse panel of the capsule bends towards the inside of the container. In particular, the recessed zone defines a sort of pocket intended to be at least partially filled by the material of the front portion of the annular seal, said material being compressed against the edge of the container when the transverse panel of the capsule is deformed. This makes it easier for the edge of the container to penetrate into the thickness of the front portion of the annular seal, so that the container is sealingly closed due to an axial (or front) sealing action exerted by the front portion of the annular seal.

In an embodiment, the recessed zone is provided in a connection region of the annular seal, in which the front portion is connected to the side portion.

In an embodiment, inside the side portion of the annular seal, a side lip is provided, the side lip projecting towards the inside of the closure element in order to engage with a side surface of the mouth of the container.

The side lip ensures a good lateral seal in the initial steps of the process of capping the container, i.e. before the axial sealing action becomes effective, said axial sealing action being due to the edge of the container engaging with the front portion of the seal. Contamination of the product inside the container, and/or undesired leakage of substances present in the container are thus avoided, even in the initial capping steps.

In addition, in the initial steps of the process of capping the container, the side lip prevents the closure element from separating from the container. If the side lip were absent, the closure element might be projected away from the container due to the fact that the vacuum level created inside the container is not yet sufficient to hold the closure element stably anchored to the mouth.

In an embodiment, the side portion of the annular seal is provided with a plurality of ribs which project towards the inside of the closure element.

The ribs have an axial dimension such that, in use, the ribs engage with a fixing element, for example an external thread which is obtained on the container, without however interacting with an annular bead provided on the container below the fixing element.

By providing ribs which do not engage with the annular bead of the container, it is possible to avoid excessive values of the unscrewing torque that needs to be applied to the closure element in order to remove the closure element from the container, without however jeopardizing the sealing properties of the closure element.

In an embodiment, the ribs are delimited, at their side opposite with respect to the transverse panel, by respective rounded or beveled ends. Owing to the rounded or beveled ends, the closure element may be applied to the container rather easily, while reducing the risk that the annular seal detaches from the capsule as the closure element is being applied to the container.

In an embodiment, at least two ribs are beveled in a less marked manner than the remaining ribs, or at least two ribs are not beveled at all.

The ribs beveled in a less marked manner define respective abutment elements, against which a closure element abuts when several closure elements are stacked one on the other in the capping machines. The ribs beveled in a less marked manner ensure that a closure element does not penetrate excessively inside the adjacent closure element, which could make it difficult to detach the closure elements from one another on the capping machines.

The invention will be better understood and implemented with reference to the appended figures that illustrate some exemplifying and non-limitative embodiments thereof, in which:

FIG. 1 is a perspective view of a closure element of the press-twist type;

FIG. 2 is a top view of the closure element of FIG. 1;

FIG. 1 shows a closure element 1 for closing a container. The closure element 1 is of the so-called "press-twist" or "press-on, twist-off" type, i.e. it is intended to be applied by pressure onto the container the first time the container is closed, and it is intended to be removed from the container by unscrewing.

Figure 6:
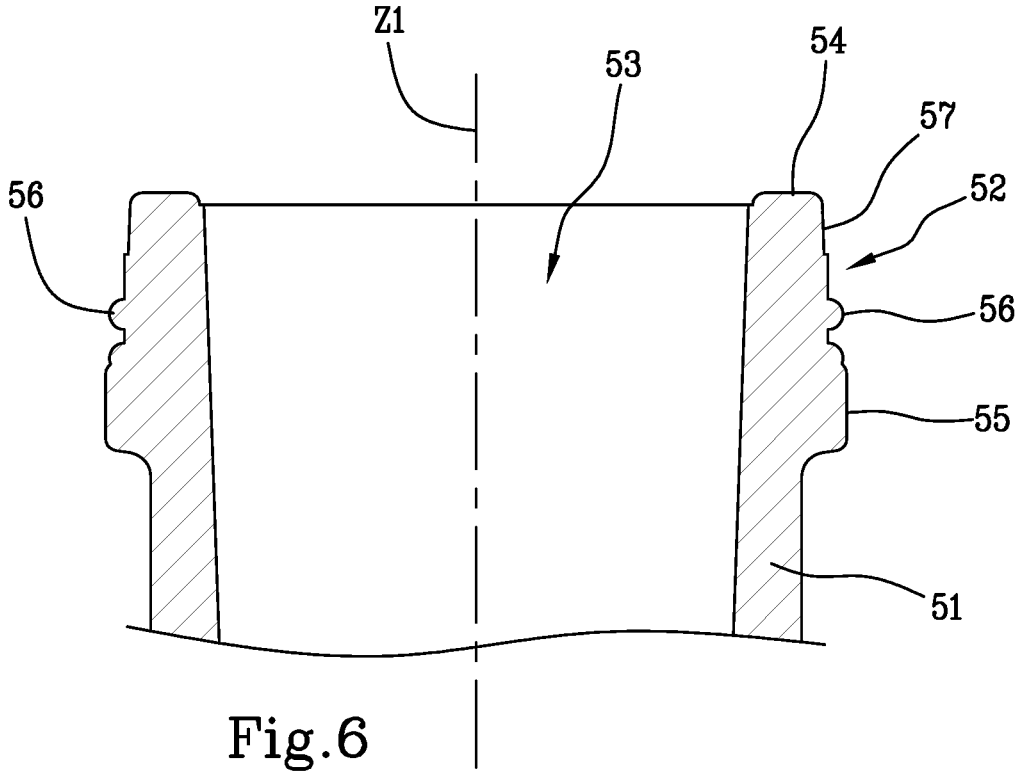
FIG. 6 is a schematic interrupted section showing a neck of a container.

The closure element 1 is particularly suitable for being used for closing a container 51 of the type shown in FIG. 6. The container 51 may be made of glass. The container 51 may be designed to contain vacuum packaged foodstuffs, such as baby foods, sauces, fruit juices, fish and seafood, meat based products, animal foodstuffs and the like.

The container 51 comprises a mouth 52 which delimits an opening 53 through which the container 51 may be filled and emptied. The mouth 52 extends about a longitudinal axis Z1. The mouth 52 is delimited by an edge 54 which can be defined as an upper edge of the mouth 52 because, when the container 51 rests on a horizontal surface in a use position, the edge 54 superiorly the mouth 52 at the top thereof. In the example shown, the edge 54 is delimited by a substantially flat annular surface, which extends transversely, in particular perpendicularly, to the longitudinal axis Z1.

The container 51 comprises an annular bead 55 that projects radially towards the outside of the container 51, below the edge 54.

Between the edge 54 and the annular bead 55 one or more fixing elements 56 are provided, the fixing elements 56 being shaped as threads or more generally as projections, which project towards the outside of the container 51 so as to allow the closure element 1 to be fastened to the container 51.

The closure element 1 comprises a capsule 2, particularly made of metal material, for example of shaped sheet metal.

Figure 3:
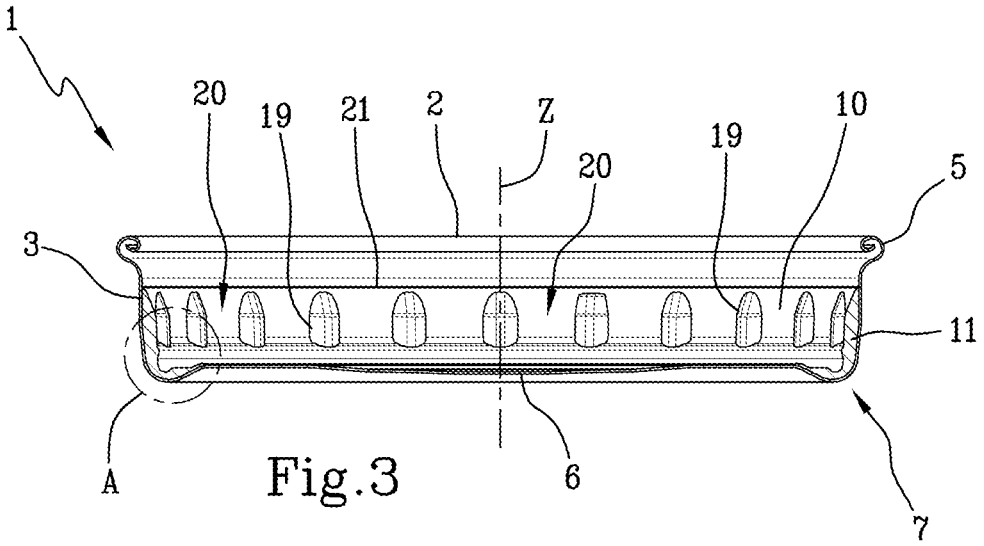
FIG. 3 is a cross section taken along the plane III-III of FIG. 2.

As shown in FIG. 3, the capsule 2 comprises a side wall 3, which extends about an axis Z, and a transverse panel 4, arranged transversely, in particular perpendicularly, to the axis Z. The side wall 3 allows the closure element 1 to be anchored to the container 51. The transverse panel 4 allows on the other hand the opening 53 to be closed, when the closure element 1 is applied to the container 51. When the closure element 1 is applied to the container 51, the axis Z of the closure element 1 coincides with the longitudinal axis Z1 of the container 51.

The side wall 3 is shaped as a substantially cylindrical skirt. The side wall 3 has an end region connected to the transverse panel 4. At a further end region of the side wall 3, opposite the end region adjacent to the transverse panel 4, the side wall 3 is delimited by a rolled edge 5 forming a sort of curl which is folded towards the inside of the closure element 1. The rolled edge 5 has the purpose to make a sharp edge inaccessible, thereby preventing a user from being injured. This sharp edge is the edge along which the sheet metal which forms the closure element 1 was cut.

The transverse panel 4 is substantially flat.

In the example shown, the transverse panel 4 is provided with an opening indicator element 6, which is shaped as a protrusion, particularly a circular protrusion, protruding from the center of the transverse panel 4. When the closure element 1 is not applied to a container 51, the opening indicator element 6 protrudes towards the outside of the closure element 1, i.e. towards the side of the transverse panel 4 opposite the side from which the side wall 3 protrudes. When the closure element 1 is applied to a container 51 inside which a vacuum is created, the opening indicator element 6 is deformed towards the inside of the container. Thus, by observing the opening indicator element 6, it is possible to determine whether the container 51 closed by its closure element 1 has already been opened or not. Indeed, if the container 51 has already been opened, the opening indicator element 6 protrudes towards the outside of the closure element 1. On the other hand, if the container 51 has never been opened and is therefore still sealingly closed, the opening indicator element 6 is deformed towards the inside of the container 51.

Furthermore, when the closure element 1 is removed for the first time from the container 51, the opening indicator element 6 emits a sound, in particular a kind of "click" perceptible by the user. This sound is generated when the opening indicator element 6 passes from the configuration deformed towards the inside of the container 51, to the configuration in which the opening indicator element protrudes towards the outside of the closure element 1. When hearing the sound mentioned above, the user is sure that before removing the closure element 1, the container 51 was properly closed, i.e. sealingly closed.

Figure 4:
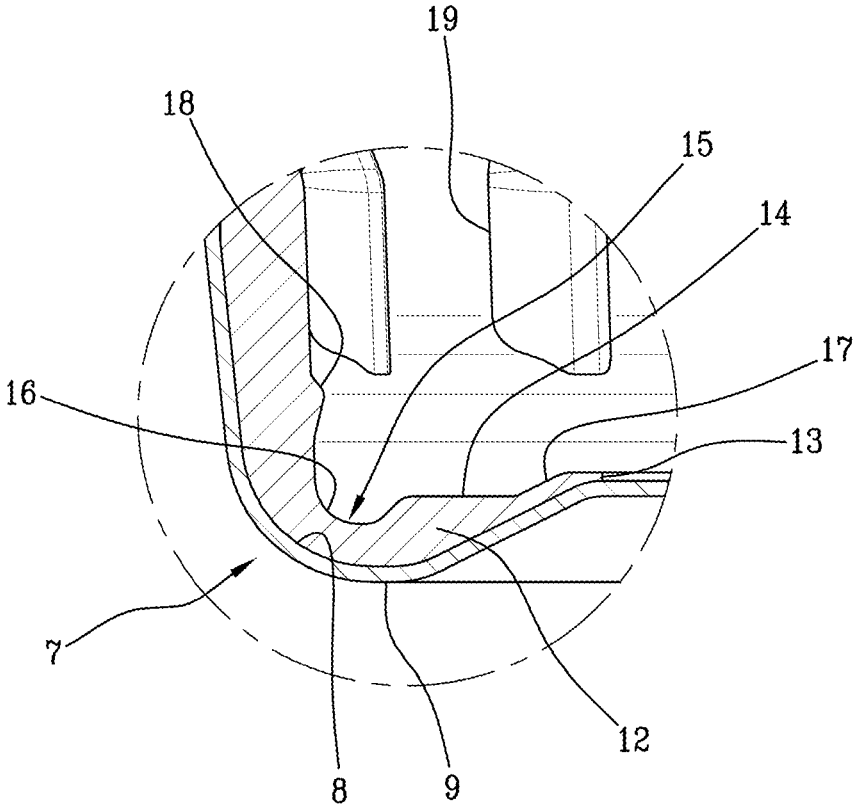
FIG. 4 is an enlarged and interrupted section view, showing the detail A of FIG. 3.

The side wall 3 is connected to the transverse panel 4 in a connection zone 7, in which, as shown in FIG. 4, a seat 8 may be obtained. The seat 8 may be particularly shaped as an annular groove. The seat 8 is facing towards the inside of the capsule 2 and surrounds the transverse panel 4. In the example shown, the seat 8 is defined inside a projection 9 which protrudes towards the outside of the closure element 1.

The closure element 1 further comprises an annular seal 10, which is suitable for engaging with the mouth 52 of the container 51 in order to sealingly close the latter. The annular seal 10 is made of a polymeric or elastomeric material, or mixtures thereof, and is free of polyvinylchloride (PVC). The annular seal 10 can be obtained by introducing the corresponding material in the molten state and with an annular conformation inside the capsule 2, and by suitably shaping this material by means of a mould.

The annular seal 10 comprises a side portion 11 arranged in contact with the side wall 3. The side portion 11 extends continuously about the axis Z. As better described in a later section, the side portion 11 is intended to interact with the fixing elements 56 which are obtained on the container 51.

The annular seal 10 further comprises a front portion 12, which extends from the side portion 11 towards the axis Z. The front portion 12 is intended to interact with the edge 54 which delimits the mouth 52 of the container 51 at the top thereof, as it will be better described later. The front portion 12 extends in the connection zone 7, in particular inside the seat 8. The front portion 12 has a free inner edge 13 which, in the example shown, is arranged in a zone in which the seat 8 ends and the transverse panel 4 begins. In an alternative embodiment, the inner free edge 13 might be more protruding towards the axis Z, i.e. the inner free edge 13 might cover a larger part of the transverse panel 4 than what is shown in FIG. 4.

The front portion 12 is delimited by a sealing surface 14, shown in FIG. 4, suitable for contacting the edge 54 of the container 51 so that the container 51 may be sealed by the closure element 1. The sealing surface 14 is a flat annular surface, which extends transversely, in particular perpendicularly, to the axis Z of the closure element 1.

The annular seal 10 further comprises a deformability promoting element 15 for increasing deformability of the front portion 12.

The deformability promoting element 15 comprises a recessed zone 16 defining a sort of pocket which may be at least partially filled with the material forming the front portion 12 during a capping process for capping the container 51.

The recessed zone 16 is obtained outside of the sealing surface 14 in a connection region that connects the front portion 12 and the side portion 11. In the example shown, the recessed zone 16 is shaped as a continuous groove having an annular shape, in particular a circular conformation. The recessed zone 16 extends about the axis Z coaxially to this axis.

The recessed zone 16 is obtained in a portion of material forming the annular seal 10, which is housed inside the seat 8. In other words, the recessed zone 16 penetrates towards the inside of the seat 8 with respect to the front surface 14.

The recessed zone 16 is interposed between the front surface 14 and the side portion 11 of the annular seal 10.

As better disclosed hereinafter, the deformability promoting element 15, and in particular the recessed zone 16, allows to increase deformability of the front portion 12, when the closure element 1 is being applied onto the container 51. In particular, as it will be better described later, owing to the recessed zone 16, the edge 54 of the container 51 is able to penetrate easily into the front portion 12, thereby engaging sealingly with the latter.

The front portion 12 may further comprise a step 17 interposed between the front surface 14 and the inner free edge 13 of the annular seal 10. The step 17 allows to connect the inner free edge 13, which is placed on the transverse panel 4, with the front surface 14, which is located at a different level with respect to the transverse panel 4. In an alternative embodiment, the step 17 may however be omitted.

The annular seal 10 further comprises a side lip 18 projecting towards the inside of the closure element 1 from the side portion 11. The side lip 18 is configured to engage with a side surface 57 of the container 51, the side surface 57 being interposed between the fixing elements 56 and the edge 54. As better described later on, the side lip 18 allows the closure element 1 to be retained on the container 51 during the initial steps of the capping process.

The side lip 18 is arranged near the recessed zone 16. The side lip 18 is shaped as a protrusion which protrudes from the side portion 11 towards the axis Z, while extending continuously about the axis Z.

At the side opposite the front portion 12, the side portion 11 is delimited by a free edge 21.

Figure 7:
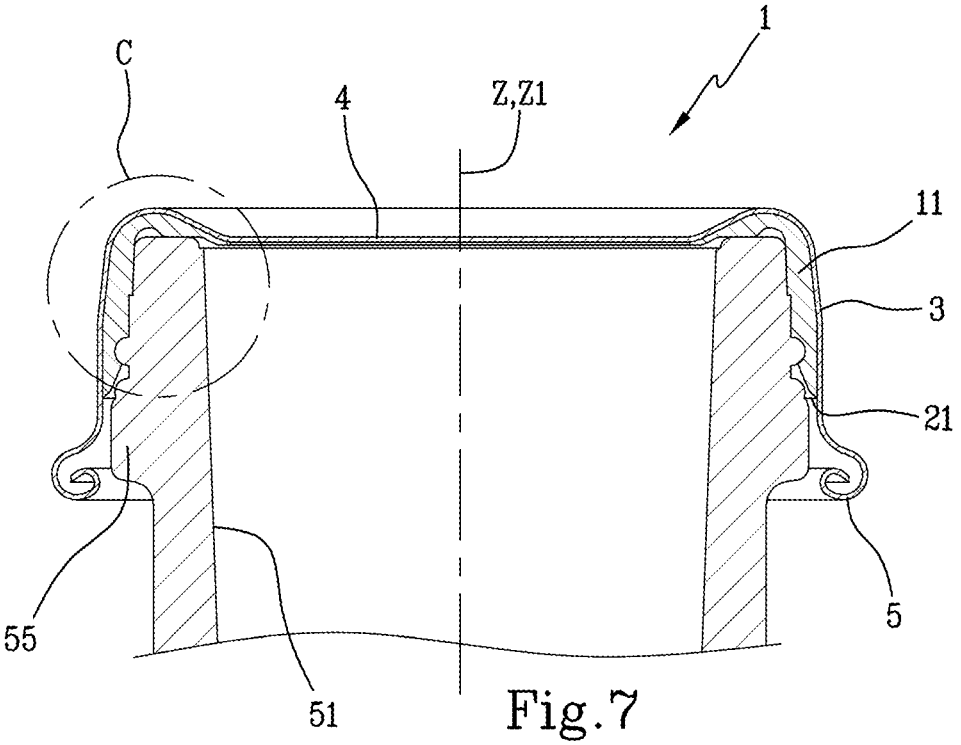
FIG. 7 is a schematic section showing a closure element applied on the neck of FIG. 6.

As shown in FIGS. 3 and 7, the free edge 21 is spaced apart from the rolled edge 5 of the capsule 2. The position of the free edge 21, i.e. the length of the side portion 11 parallelly to the axis Z, is determined on the basis of the position of the annular bead 55 of the container 51 with which the closure element 1 is intended to engage. In particular, the side portion 11 is dimensioned in such a manner that, when the closure element 1 is applied to the container 51, the free edge 21 does not contact the annular bead 55, i.e. the free edge 21 is spaced apart from the annular bead 55.

In other words, the side portion 11 may be so dimensioned that, when the closure element 1 is applied to the container 51 so as to close the container 51 substantially sealingly, the free edge 21 of the annular seal 10 does not create any interference with the annular bead 55. By way of non-limiting example, this condition may occur when the free edge 21 of the annular seal 10 is located at a distance of at least 0.1 mm from the annular bead 55.

Thus, any undesired interference between the annular bead 55 and the annular seal 10 is avoided. This interference would be of no practical usefulness for the purposes of sealingly closing the container 51, but may instead be detrimental, by resulting in an excessive increase of the unscrewing torque required for removing the closure element 1 from the container 51.

The annular seal 10 further comprises a plurality of ribs 19 protruding from the side portion 11 towards the axis Z, i.e. towards the inside of the closure element 1. The ribs 19 extend longitudinally inside the closure element 1 and can be particularly directed parallel to the axis Z.

The ribs 19 are distributed in a regular manner about the axis Z, i.e. they are angularly equidistant about the axis Z.

When the closure element 1 is applied onto the container 51, the ribs 19 engage with the fixing elements 56. In particular, the fixing elements 56 permanently deform the ribs 19, on which respective recesses remain impressed, said recesses having a shape complementary to that of the fixing elements 56. For example, if the fixing elements 56 are shaped as external threads, when the closure element 1 is removed from the container 51, the ribs 19 are so deformed as to exhibit portions of internal threads having a complementary shape to the shape of the external threads obtained on the container 51. This allows the user to re-apply the closure element 1 onto the container 51 by screwing it on the latter.

The ribs 19 thus allow the closure element 1 to be removed from the container 51.

The ribs 19 define respective contact zones, in which the annular seal 10 is in contact with the fixing elements 56. Between two adjacent ribs 19, an interspace 20 is defined. When the closure element 1 is applied to the container 51, at the interspaces 20 the fixing elements 56 compress the side portion 11 to a limited extent, or they do not compress it at all.

As shown in FIG. 3, each rib 19 extends from the side lip 18 towards the free edge 21. The axial dimension of the ribs 19, i.e., the length thereof parallel to the axis Z, is selected in such a manner that, when the closure element 1 is applied to the container 51, the ribs are spaced apart from the bead 55, so as not to interact with the latter.

In particular, the ribs 19 may terminate near the free edge 21 of the annular seal 10.

Figure 5:
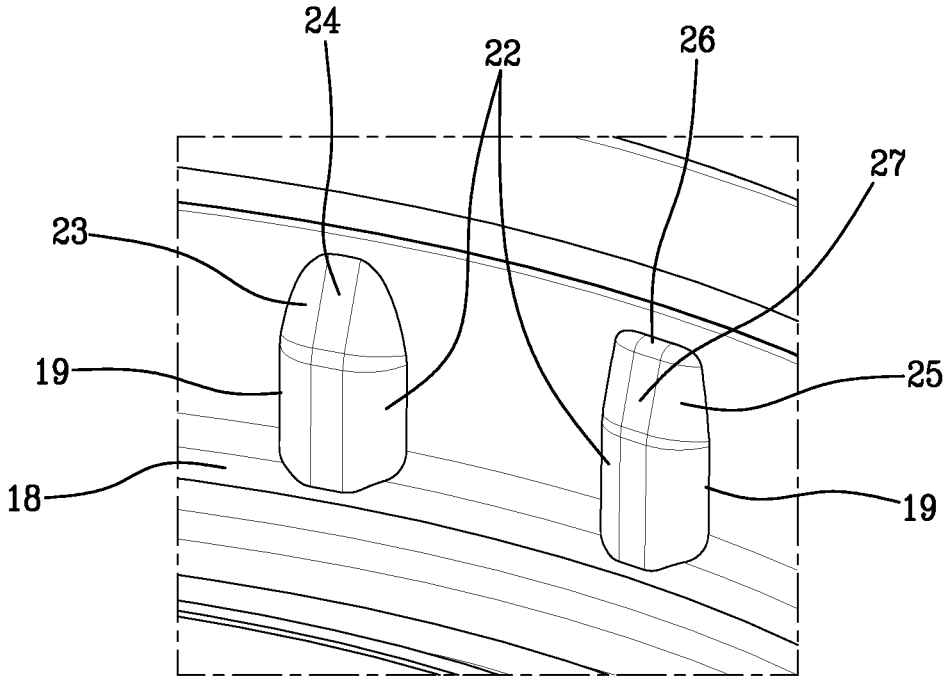
FIG. 5 is an enlarged and interrupted view showing the detail B of FIG. 1.

As shown in FIG. 5, each rib 19 has a body 22, which may be of an approximately semi-cylindrical shape and which, in the example shown, extends parallel to the axis Z. Each rib 19 has an end facing the rolled edge 5, i.e. opposite the transverse panel 4. The ends of the ribs 19 facing the rolled edge 5 may have different conformations, in particular two different conformations.

Most of the ribs 19 have an inserting end 23 facing the rolled edge 5, i.e. opposite the transverse panel 4, the inserting end 23 being so shaped as to promote application of the closure element 1 to the container 51. The inserting end 23 may be particularly beveled or rounded.

In the example shown, at the inserting ends 23, the dimensions of the ribs 19 are reduced with respect to the body 22, both in an axial direction, i.e. parallel to the axis Z, and in a radial direction, i.e. perpendicular to the axis Z. In a central zone thereof, the inserting ends 23 are delimited by a tilted surface 24, which is shaped as a substantially flat surface extending from the side wall 3 to the body 22.

The inserting ends 23 allow the closure element 1 to be applied more easily to the container 51. Owing to the inserting ends 23, the risk is reduced that, while the closure element 1 is being pushed against the mouth 52 in order to be applied to the container 51 for the first time, an excessive interference occurs between the ribs 19 and the container 51, which might cause the annular seal 10 to detach from the closure element 1, while the latter is being applied by pressure onto the mouth 52.

A certain number of ribs 19 may be provided on the annular seal 10, said ribs having a spacer end 25 opposite the transverse panel 4. The spacer ends 25 have a shape different from the shape of the inserting ends 23. The spacer ends 25 are delimited by an abutment surface 26, which is arranged in a distal position with respect to the transverse panel 4. As it will be better described below, the abutment surfaces 26 are suitable for contacting an outer surface of the transverse panel 4 of an adjacent closure element 1.

Also the spacer ends 25 can be beveled or rounded, albeit in a less marked manner than the inserting ends 23.

The spacer ends 25 may be delimited by a tilted face 27, which is substantially flat and extends from the body 22. However, between the tilted face 27 and the side wall 3, the abutment surface 26 is interposed. The abutment surface 26, in a direction parallel the axis Z, has a curvature different from that of the tilted face 27.

In the example shown, three ribs 19 are provided which are delimited by a spacer end 25 as shown in FIG. 2. It is however possible to provide a number of ribs 19 delimited by spacer ends 25, different from three, particularly between two and six ribs 19 delimited by spacer ends 25. The ribs 19 delimited by spacer ends 25 are angularly equidistant about the axis Z, i.e.—in the example shown—they are separated from one another by angles of 120°. Between two ribs 19 delimited by spacer ends 25, a plurality of ribs 19 is interposed which are delimited by inserting surfaces 23.

The closure elements 1 are applied to the respective containers 51 by means of a capping machine, which receives the incoming closure elements 1 arranged in a preferably stacked arrangement. According to this arrangement, inside a closure element 1 the transverse panel 4 of an adjacent closure element 1 is housed, as well as a portion of the transverse wall 3 of the adjacent closure element 1. The spacer ends 25 prevent each closure element 1 from penetrating excessively inside the closure element 1 which partially houses the closure element 1 at issue. In fact, a closure element 1 may be inserted inside an adjacent closure element 1, up to reaching a position in which the transverse panel 4 of the innermost closure element 1 is in contact with the spacer ends 25 of the outermost closure element 1. This prevents the innermost closure element 1 from being inserted too deeply inside the outermost closure element 1, in which case it might be difficult to remove the innermost closure element 1, that could remain stuck in the outermost closure element 1.

After separating the individual closure elements 1 from the initial stacked arrangement, the closure elements 1 are moved along a slide of the capping machine in such a manner that a cavity 28 is facing downwards, the cavity 28 being defined between the transverse panel 4 and the side wall 3, i.e. inside the closure element 1. At the same time, a high temperature fluid, particularly water vapor, is sent inside the closure element 1, i.e. inside the cavity 28, the high temperature fluid allowing the closure element 1 to be sterilized and the material of the annular seal 10 to be softened. Right after, the closure element 1 is placed onto the mouth 52 of the corresponding container 51 and then pressed against the mouth 52 by a pressing element, for example a plate-like pressing element.

The conformation of the inserting ends 23 makes it possible to insert the mouth 52 of the container 51 inside the cavity 28 of the closure element 1 relatively easily. In particular, in the early steps of inserting the mouth 52 into the cavity 28, friction between the annular seal 10 and the container 51 is minimized, so that the annular seal 10 is prevented from detaching from the closure element 1.

The closure element 1 is gradually pushed towards the container 51, so that the mouth 52 fits into the cavity 28 up to reaching, at the capping machine outlet, a configuration in which the edge 54 of the container 51 is in contact, or nearly in contact, with the front portion 12 of the annular seal 10.

Figure 8:
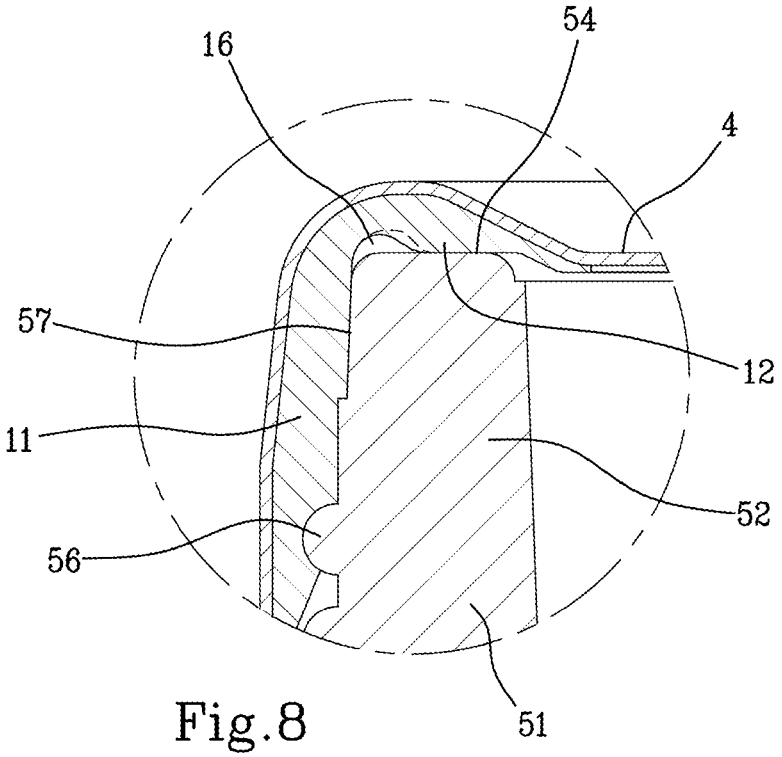
FIG. 8 is an enlarged and interrupted section showing the detail C of FIG. 7.

In this step, the front portion 12 of the annular seal 10 is however not yet sealingly engaged with the edge 54 of the container 51. Sealing is ensured at this time by the side lip 18, which is deformed due to interference with the side surface 57 of the container 51, thereby assuming a substantially cylindrical configuration as shown in FIG. 8. This cylindrical configuration corresponds to the shape of the side surface 57. The side lip 18 therefore exerts an action of lateral seal on the container 51.

When the closure element 1 is applied on the container 51, which has previously been filled to a desired level with a predetermined product, between the transverse panel 4 and an upper free surface of the product contained in the container 51, a headspace is defined, in which a certain amount of air remains trapped. This air is heated by the high temperature fluid previously sent inside the closure element 1. At the outlet of the capping machine, the air trapped inside the headspace cools, thereby creating an initial, although slight, vacuum inside the container 51. This vacuum tends to keep the closure element 1 anchored to the container 51. The side lip 18 ensures that, even in the case in which the vacuum present inside the headspace of the container 51 is not sufficient per se to keep the closure element 1 anchored to the mouth 52, the closure element 1 anyway does not separate from the container 51.

Indeed, the side lip 18 is coupled with interference to the side surface 57 and is acting as a retaining element for retaining the closure element 1 associated with the container 51.

Downstream of the capping machine, there are provided plants for sterilizing or pasteurizing the containers 51, particularly in an autoclave. In such plants, the container 51 is again heated and is furthermore subjected to high external pressures. The closure element 1 is consequently pushed with greater force towards the container 51, and the edge 54 presses on the front portion 12 of the annular seal 10 with increased intensity. Due to the high temperatures present inside the plant, the material forming the annular seal 10 is in a softening condition. Furthermore, as a result of the pressure exerted by the edge 54 of the container 51, the material forming the annular seal 10 is deformed thereby partially flowing inside the recessed zone 16, i.e. it fills a part of the volume defined inside the recessed zone 16. This is clearly visible in the detail of FIG. 8, in which the dotted line shows the profile of the recessed zone 16 before deformation of the front portion 12 took place.

The recessed zone 16 makes it easier to deform the material forming the front portion 12, so that the capability of the edge 54 to penetrate into the front portion 12 is increased. This results in an effective front sealing action between the edge 54 of the container 51 and the front portion 12 of the annular seal 10, notwithstanding that the material forming the annular seal 10 is free of PVC, and thus relatively stiff. The product contained in the container 51 is thus prevented from being contaminated.

In an embodiment that is not shown, the deformability promoting element 15 may comprise, in addition to or in place of the recessed zone 16, a thinned zone which is obtained on an inner diameter of the front portion 12, i.e. near the free inner edge 13. The thinned zone may for example be shaped as a groove or as a chamfer. A thinned zone of this type makes it easier to deform the front portion 12 near the free inner edge 13.

Figure 9:
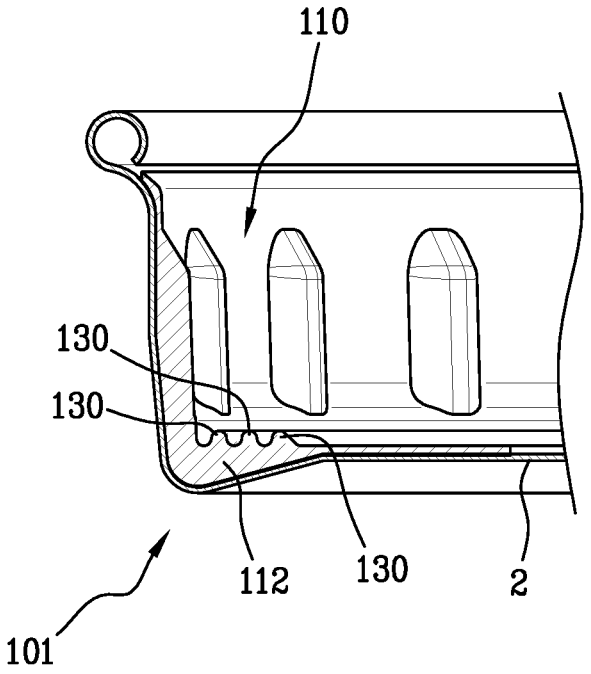
FIG. 9 is an enlarged and interrupted section view showing a detail of a closure element according to an alternative embodiment.

FIG. 9 shows a closure element 101 comprising a capsule 2 provided with an annular seal 110 according to an alternative embodiment. The annular seal 110 differs from the annular seal 10 shown in FIGS. 1 to 8 mainly because it does not have the recessed zone 16 with which the annular seal 10 is instead provided. The annular seal 110 is provided with a front portion 112 from which three circular protrusions 130 are protruding, which are concentric to one another and with the center thereof on the axis Z.

Figure 10:
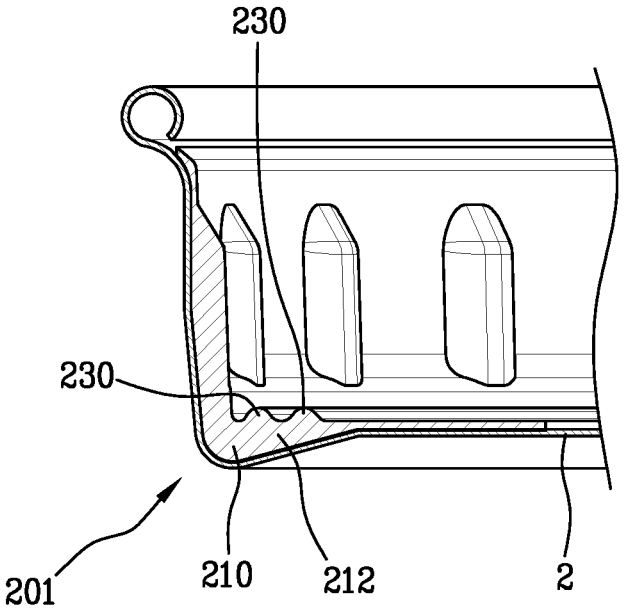
FIG. 10 is an enlarged and interrupted section view showing a detail of a closure element according to a further alternative embodiment.

FIG. 10 shows a closure element 201 the capsule 2 of which is provided with an annular seal 210, wherefrom two circular protrusions 230 are protruding that are concentric one to another and centered on the axis Z. The circular protrusions 230 are projecting from the front portion 212 inwards of the closure element 1.

Figure 11:
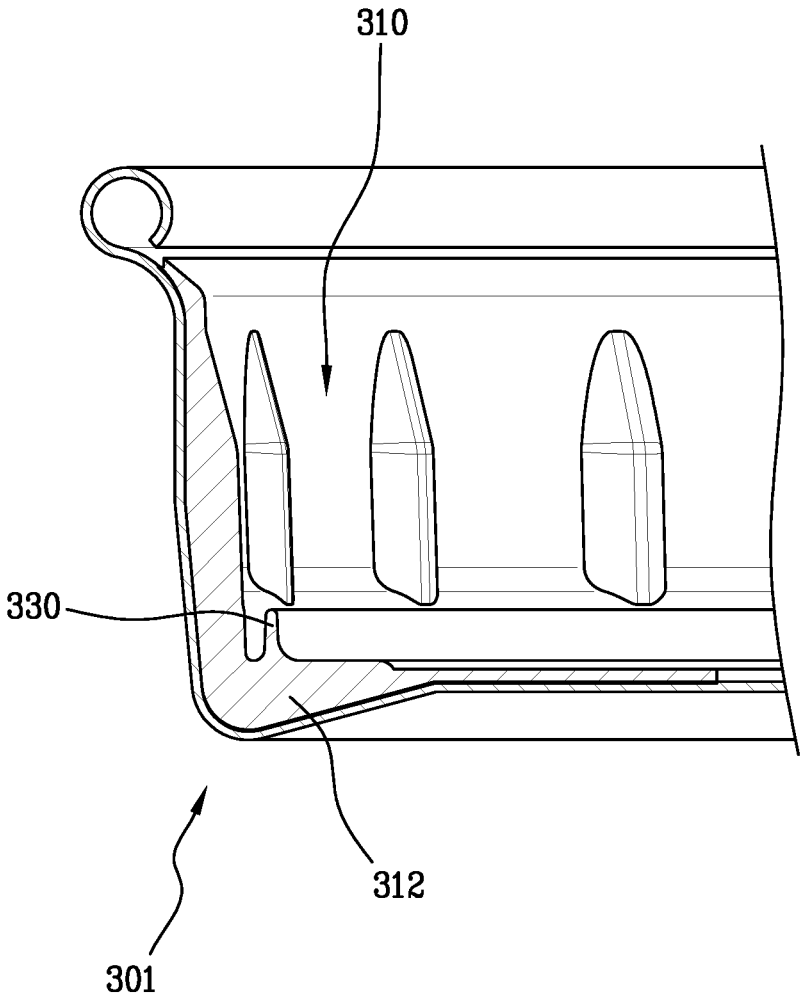
FIG. 11 is an enlarged and interrupted section view showing a detail of a closure element according to another alternative embodiment.

In the embodiment of FIG. 11 there is provided a closure element 301 whose capsule 2 is instead provided with an annular seal 310 having a single circular protrusion 330. The latter is protruding from the front portion 312 inwards of the closure element 1. The circular protrusion 330 has a greater length than the circular protrusions 130, 230 shown in FIGS. 9 and 10, and is thinner than said circular protrusions.

When the closure elements 101, 201, 301 are applied to respective containers, the circular protrusions 130, 230, 330 are in contact with the upper edge of the container and crushed against the latter, thus acting as sealing lips which ensure an effective closure of the container.

The invention claimed is:

1. A press-twist closure element for closing a container, comprising:

a capsule having a side wall extending about an axis, and a transverse panel extending transversely to said axis, an annular seal for sealingly engaging with a mouth of the container, wherein the annular seal is made of a PVC-free material and comprises:

a side portion arranged in contact with the side wall of the capsule;

a front portion extending from the side portion towards said axis, the front portion being delimited by a sealing surface conformed as a flat annular surface intended to contact an edge of the container, said edge delimiting the mouth;

a deformability promoting element for increasing deformability of the front portion, the deformability promoting element comprising a recessed zone suitable to be at least partially filled by the material forming the front portion for allowing said edge to penetrate into the thickness of the front portion during a capping process intended to sealingly close the container, wherein the annular seal further comprises a plurality of longitudinal ribs projecting from the side portion towards the inside of the closure element for engaging with at least one fixing element of the container, at least a first group of ribs of said plurality of longitudinal ribs comprising ribs having respective inserting ends, the inserting ends being beveled or rounded for promoting application of the closure element onto the mouth by pressure, and wherein said plurality of longitudinal ribs comprises a second group of ribs which are shaped differently from the ribs of the first group, the ribs of the second group having respective spacer ends each of which is delimited by an abutment surface, the abutment surface being intended to contact a transverse panel of an adjacent closure element for preventing the adjacent closure element from penetrating excessively inside of said closure element.

2. A closure element according to claim 1, wherein the recessed zone is arranged in a connection region in which the front portion is joined to the side portion.

3. A closure element according to claim 1, wherein the recessed zone is shaped as an annular groove extending continuously about said axis.

4. A closure element according to claim 1, wherein the capsule comprises an annular projection which is projecting outwardly from the transverse panel, a seat being defined in the projection, the recessed zone penetrating inside the seat.

5. A closure element according to claim 1, wherein the recessed zone surrounds the sealing surface.

6. A closure element according to claim 1, wherein the front portion has a free inner edge which is lying on the transverse panel.

7. A closure element according to claim 6, wherein the front portion has a step which joins the sealing surface with the free inner edge.

8. A closure element according to claim 1, wherein the annular seal further comprises a side lip which projects from the side portion towards the inside of the closure element, in order to engage with a side surface of the container for exerting a side sealing action in an initial step of the capping process for capping the container.

9. A closure element according to claim 1, wherein the annular seal further comprises a side lip which projects from the side portion towards the inside of the closure element, in order to engage with a side surface of the container for exerting a side sealing action in an initial step of the capping process for capping the container, and wherein the side lip is interposed between the ribs of said plurality of longitudinal ribs and the recessed zone.

10. A closure element according to claim 1, wherein the ribs of the second group are two to six ribs and are distributed in a angularly equidistant manner about said axis, a plurality of ribs of the first group being interposed between two ribs of the second group.

11. A container comprising a mouth, the mouth having an annular bead and at least one external thread which is interposed between the annular bead and an edge of the container, a closure element according to claim 1 being applied onto the mouth, the ribs of said plurality of longitudinal ribs being spaced apart from the annular bead so as not to interfere with the annular bead.

12. A container according to claim 11, wherein at a side opposite the front portion, the side portion is delimited by a free edge and wherein the closure element is applied onto the mouth and the free edge is spaced apart from the annular bead.

13. A press-twist closure element for closing a container, comprising:

a capsule having a side wall extending about an axis, and a transverse panel extending transversely to said axis, an annular seal for sealingly engaging with a mouth of the container, wherein the annular seal is made of a PVC-free material and comprises:

a side portion arranged in contact with the side wall of the capsule;

a front portion extending from the side portion towards said axis, the front portion being delimited by a sealing surface conformed as a flat annular surface intended to contact an edge of the container, said edge delimiting the mouth;

a deformability promoting element for increasing deformability of the front portion, the deformability promoting element comprising a recessed zone suitable to be at least partially filled by the material forming the front portion for allowing said edge to penetrate into the thickness of the front portion during a capping process intended to sealingly close the container, wherein the capsule comprises an annular projection which is projecting outwardly from the transverse panel, a seat being defined in the projection, the recessed zone penetrating inside the seat.

14. A press-twist closure element for closing a container, comprising:

a capsule having a side wall extending about an axis, and a transverse panel extending transversely to said axis, an annular seal for sealingly engaging with a mouth of the container, wherein the annular seal is made of a PVC-free material and comprises:

a side portion arranged in contact with the side wall of the capsule;

a front portion extending from the side portion towards said axis, the front portion being delimited by a sealing surface conformed as a flat annular surface intended to contact an edge of the container, said edge delimiting the mouth;

a deformability promoting element for increasing deformability of the front portion, the deformability promoting element comprising a recessed zone suitable to be at least partially filled by the material forming the front portion for allowing said edge to penetrate into the thickness of the front portion during a capping process intended to sealingly close the container, wherein the front portion has a free inner edge which is lying on the transverse panel.

15. A closure element according to claim 14, wherein the front portion has a step which joins the sealing surface with the free inner edge.

* * * * *